US009031433B2

(12) United States Patent
Nakajima

(10) Patent No.: US 9,031,433 B2
(45) Date of Patent: May 12, 2015

(54) IMAGE FORMING APPARATUS, NON-TRANSITORY COMPUTER READABLE MEDIUM, AND IMAGE FORMING METHOD

(71) Applicant: Fuji Xerox Co., Ltd., Tokyo (JP)

(72) Inventor: Takaharu Nakajima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 21 days.

(21) Appl. No.: 14/047,210

(22) Filed: Oct. 7, 2013

(65) Prior Publication Data

US 2014/0119756 A1 May 1, 2014

(30) Foreign Application Priority Data

Oct. 25, 2012 (JP) ..... 2012-235591
Sep. 20, 2013 (JP) ..... 2013-184975

(51) Int. Cl.
*G03G 15/20* (2006.01)
*G03G 15/00* (2006.01)
*G03G 15/01* (2006.01)

(52) U.S. Cl.
CPC ..... *G03G 15/205* (2013.01); *G03G 15/0115* (2013.01); *G03G 15/5025* (2013.01); *G03G 2215/209* (2013.01)

(58) Field of Classification Search
CPC ..... G03G 13/20
USPC ..... 399/49, 67, 69
See application file for complete search history.

(56) References Cited

U.S. PATENT DOCUMENTS

2009/0067869 A1* 3/2009 Toyonori et al. ..... 399/69

FOREIGN PATENT DOCUMENTS

JP 2002-333794 11/2002

* cited by examiner

*Primary Examiner* — Susan Lee
(74) *Attorney, Agent, or Firm* — Oliff PLC

(57) ABSTRACT

An image forming apparatus includes an image forming unit, a density-corrected image forming unit, a measurement unit, an image correction unit, and a fixing unit. The image forming unit forms an image represented by image data as a toner image. The density-corrected image forming unit forms a density corrected image. The measurement unit measures the density of the density corrected image. The image correction unit performs image correction such that a non-halftone image is formed as a halftone image whose halftone percentage is less than 100%. The fixing unit, in a case where the image correction unit performs image correction for image data, fixes a toner image on a recording medium with at least one of an increased fixing temperature, an increased fixing time period, and an increased fixing pressure, the toner image being based on the image data for which image correction has been performed.

12 Claims, 8 Drawing Sheets

IMAGE PERCENTAGE OF 50%

IMAGE FORMING APPARATUS, NON-TRANSITORY COMPUTER READABLE MEDIUM, AND IMAGE FORMING METHOD

CROSS-REFERENCE TO RELATED APPLICATIONS

This application is based on and claims priority under 35 USC 119 from Japanese Patent Application No. 2012-235591 filed Oct. 25, 2012 and Japanese Patent Application No. 2013-184975 filed Sep. 6, 2013.

BACKGROUND

Technical Field

The present invention relates to an image forming apparatus, a non-transitory computer readable medium, and an image forming method.

SUMMARY

According to an aspect of the invention, there is provided an image forming apparatus including an image forming unit, a density-corrected image forming unit, a measurement unit, an image correction unit, and a fixing unit. The image forming unit forms an image represented by image data as a toner image. The density-corrected image forming unit forms a density corrected image. The measurement unit measures the density of the density corrected image formed by the density-corrected image forming unit. The image correction unit performs image correction on the basis of the density corrected image such that a non-halftone image represented by data included in image data is formed as a halftone image whose halftone percentage is less than 100%, the density of the density corrected image having been measured by the measurement unit. The fixing unit, in a case where image correction is performed for image data by the image correction unit, fixes a toner image on a recording medium with at least one of an increased fixing temperature, an increased fixing time period, and an increased fixing pressure, the toner image being based on the image data for which image correction has been performed.

BRIEF DESCRIPTION OF THE DRAWINGS

Exemplary embodiments of the present invention will be described in detail based on the following figures, wherein.

DETAILED DESCRIPTION

Figure 1:
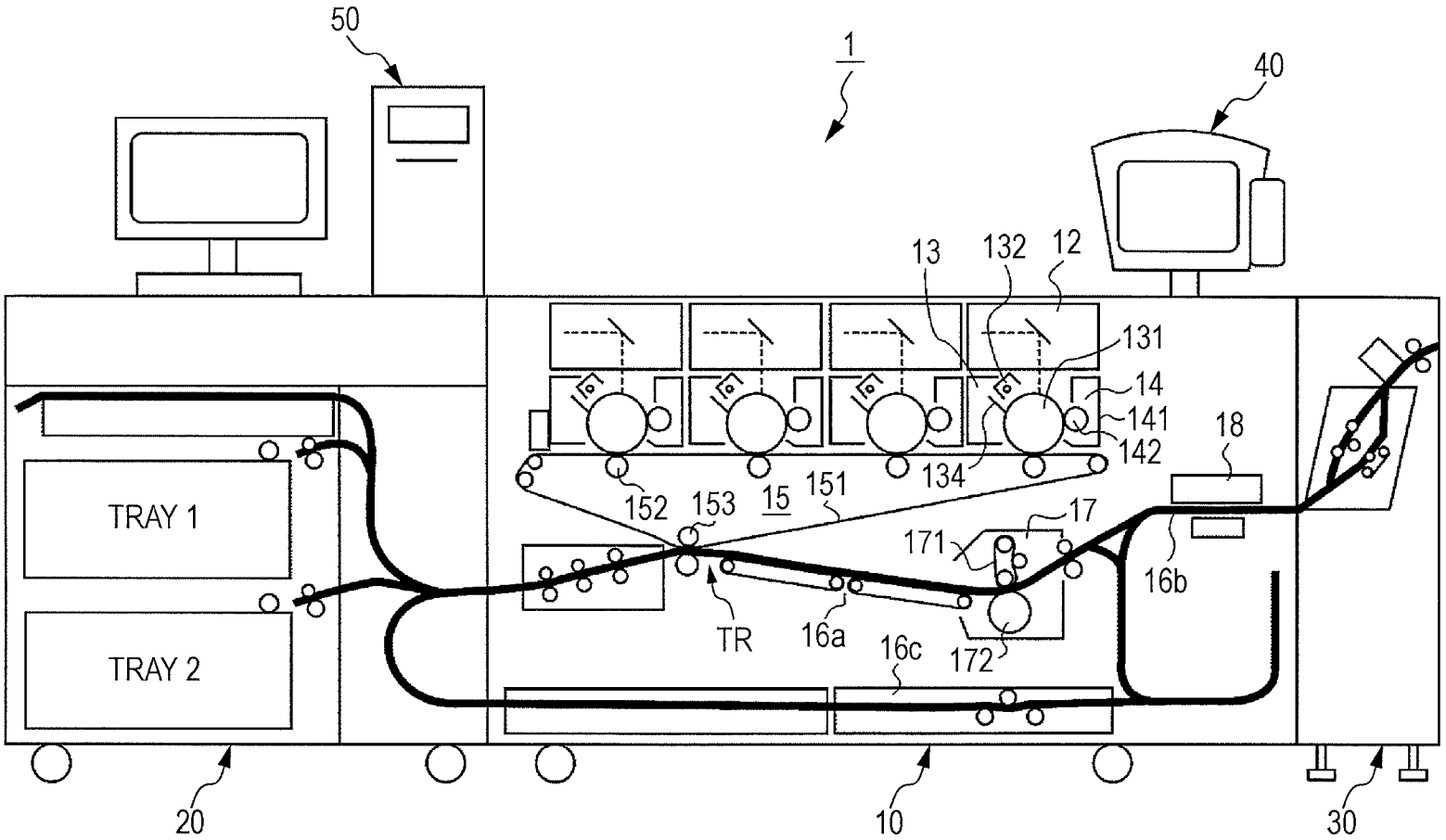
FIG. 1 is a cross-sectional schematic diagram illustrating an example of a schematic structure of an image forming apparatus.

Exemplary embodiments and specific examples are stated in the following with reference to the drawings and the present invention will be further described in detail. However, the present invention is not limited to these exemplary embodiments and specific examples.

Note that the drawings are schematic and the ratios between the actual dimensions and the like are different from the ratios described below with reference to the drawings. For the sake of better understanding, members that are unnecessary for the description are omitted in the drawings as necessary.

First Exemplary Embodiment

(1) Overall Structure and Operation of Image Forming Apparatus (1.1) Overall Structure of Image Forming Apparatus FIG. 1 is a cross-sectional schematic diagram illustrating an example of a schematic structure of an image forming apparatus 1 according to a first exemplary embodiment. The image forming apparatus 1 includes an image forming unit 10 serving as an exemplary image forming unit, a sheet feeding device 20 provided at one end of the image forming unit 10, a sheet ejecting unit 30 that is provided at the other end of the image forming unit 10 and from which a printed sheet is ejected, an operation information unit 40, and an image processing unit 50 that generates image information from print information transmitted from a connected device.

The image forming unit 10 includes a system controller 11, exposure devices 12, photoconductor units 13, developing devices 14, a transfer device 15, sheet transport devices 16*a*, 16*b*, and 16*c*, a fixing device 17, and an image reading device 18. The image forming unit 10 receives image information from the image processing unit 50 and forms a toner image by using the image information on a sheet fed by the sheet feeding device 20.

The sheet feeding device 20 feeds sheets to the image forming unit 10. The sheet feeding device 20 has plural sheet carrying units and the sheets contained differ from sheet-carrying-unit to sheet-carrying-unit (for example, in terms of material, thickness, sheet size, or grain direction). The sheet feeding device 20 feeds a sheet transported from one of these plural sheet carrying units to the image forming unit 10.

The sheet ejecting unit 30 ejects a sheet on which image output has been performed by the image forming unit 10. For sheet ejection, the sheet ejecting unit 30 has an ejected sheet holding unit to which a sheet on which image output has been performed is ejected. Note that the sheet ejecting unit 30 may have a post-processing function with which cutting, stapling (binding with staples), or the like is performed on a bundle of sheets output from the image forming unit 10.

The image forming unit 10 is equipped with the operation information unit 40. The operation information unit 40 is used to set various settings, input an instruction, and display information. That is, the operation information unit 40 is what is called an interface and is specifically configured by combining a liquid crystal display panel, various operation buttons, a touch screen, and the like.

(1.2) Structure and Operation of Image Forming Unit

In the image forming apparatus 1 having such a structure, one of the sheet carrying units is specified on a sheet-by-sheet basis for printing and a sheet transported from a corresponding one of the sheet carrying units of the sheet feeding device 20 is fed to the image forming unit 10 at a timing appropriate for a timing at which image forming is performed.

The photoconductor units 13 are provided in parallel with one another under the exposure devices 12. Each photoconductor unit 13 includes a photoconductor drum 131 serving as an image holding member that rotates. A current-charging part 132, an exposure device 12, a developing device 14, a first transfer roller 152, and a cleaning blade 134 are arranged along the direction in which the photoconductor drum 131 rotates.

Each developing device 14 includes a developing housing 141 in which a developer is contained. Inside the developing housing 141, a developing roller 142 is provided such that the developing roller 142 faces the photoconductor drum 131. A layer control member (not illustrated) that controls the thickness of a developer layer is provided near the developing roller 142.

The developing devices 14 have the same structure except that the developers contained in the developing housings 141 have different colors from one another. Each of the developing devices 14 forms a toner image, the color of which is a corresponding one of yellow (Y), magenta (M), cyan (C), and black (K).

The surface of the photoconductor drum 131 that rotates is electrically charged by the current-charging part 132 and an electrostatic latent image is formed on the surface of the photoconductor drum 131 by latent image-forming light emitted from the exposure device 12. The electrostatic latent image formed on the photoconductor drum 131 is developed as a toner image by the developing roller 142.

The transfer device 15 includes an intermediate transfer belt 151, the first transfer roller 152, and a second transfer roller 153. Toner images formed on the photoconductor drums 131 of the photoconductor units 13 are transferred onto the intermediate transfer belt 151 in a multiplex manner, the toner images being of different colors. The first transfer roller 152 subsequently transfers (or performs first transfer on) the toner images from the photoconductor units 13 onto the intermediate transfer belt 151, the toner images being of different colors. The second transfer roller 153 transfers (performs second transfer on) the toner images of the different colors from the intermediate transfer belt 151 onto a sheet by one operation, the toner images having been superimposed and transferred onto the intermediate transfer belt 151, the sheet being a recording medium.

The toner images of the different colors formed on the photoconductor drums 131 of the photoconductor units 13 are sequentially transferred (first transfer) onto the intermediate transfer belt 151 by the first transfer roller 152, to which a transfer voltage is applied by a power source or the like (not illustrated) controlled by the system controller 11. Consequently, a superimposed toner image is formed in which the toner images of the different colors are superimposed.

As the intermediate transfer belt 151 is moved, the superimposed toner image on the intermediate transfer belt 151 is transported to an area (a second transfer section TR) in which the second transfer roller 153 is provided. A sheet is supplied from the sheet feeding device 20 to the second transfer section TR at a timing appropriate for the timing at which the superimposed toner image arrives at the second transfer section TR. Then, a transfer voltage is applied to the second transfer roller 153 by a power source or the like controlled by the system controller 11 and the superimposed toner image on the intermediate transfer belt 151 is transferred onto the sheet by one operation.

The residual toner on the surface of the photoconductor drum 131 is removed by the cleaning blade 134 and collected in an abandoned-toner collecting unit (not illustrated). The surface of the photoconductor drum 131 is recharged by the current-charging part 132.

The fixing device 17 includes a fixing belt 171 and a compression roller 172, the fixing belt 171 rotating in one direction and having no ends, the compression roller 172 contacting an outer surface of the fixing belt 171 and rotating in one direction. A nip N (a fixing area) is formed by an area which is contacted and compressed by the fixing belt 171 and the compression roller 172.

A sheet onto which a toner image is transferred by the transfer device 15 is transported to the fixing device 17 via the sheet transport device 16*a* in a state in which the toner image on the sheet has not yet been fixed. The sheet transported to the fixing device 17 is compressed by a pair of the fixing belt 171 and the compression roller 172, and consequently, the toner image on the sheet is fixed by being compressed and heated.

A sheet for which fixing has been finished passes through the image reading device 18 provided downstream of the fixing device 17 in the direction in which sheets are transported and is fed to the sheet ejecting unit 30. The image reading device 18 has a function of reading image information such as an area coverage or the like recorded on a side of the sheet on which the toner image has been formed, the sheet having been ejected from the fixing device 17 and been transported to the image reading device 18.

Note that, in the case where image output is performed on both sides of a sheet, a sheet is flipped upside down by the sheet transport device 16*c* and fed again to the second transfer section TR in the image forming unit 10. Then, after toner images have been transferred and the transferred images have been fixed, the sheet is fed to the sheet ejecting unit 30. The sheet fed to the sheet ejecting unit 30 is ejected to an ejected-sheet collecting unit after being subjected to, as necessary, post-processing such as cutting, stapling (binding with staples), or the like.

(1.3) Functional Configuration and Operation of Image Forming Apparatus

Figure 2:
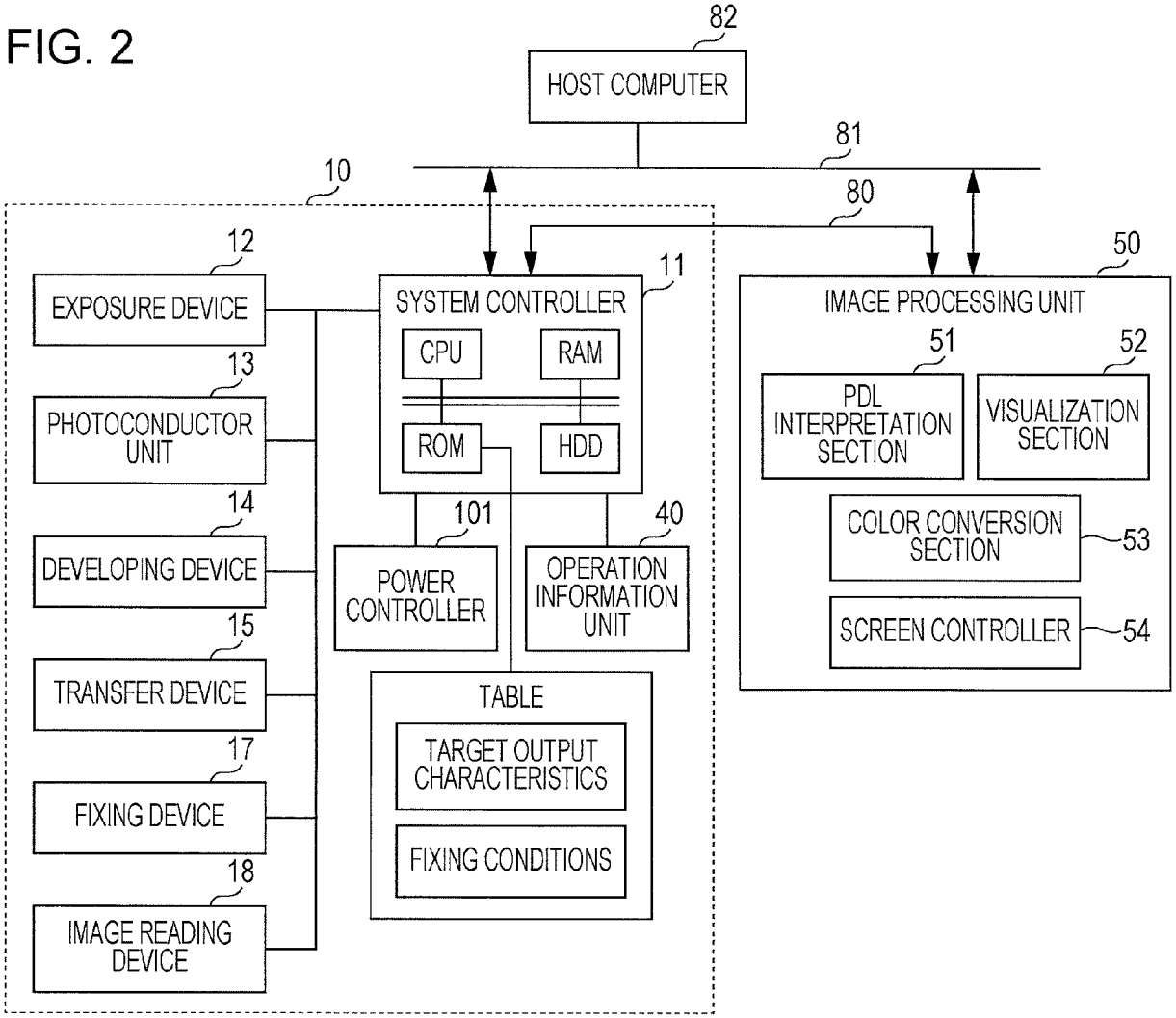
FIG. 2 is a block diagram illustrating an example of a functional configuration of the image forming apparatus.

FIG. 2 is a block diagram illustrating an example of a functional configuration of the image forming apparatus 1 according to the first exemplary embodiment.

The image forming unit 10 includes the system controller 11, an exposure device 12, a photoconductor unit 13, a developing device 14, the transfer device 15, the fixing device 17, the image reading device 18, a power controller 101, and the operation information unit 40. The system controller 11 is configured by a combination of a central processing unit (CPU), a random-access memory (RAM), a read-only memory (ROM), a hard disk drive (HDD), and the like. The exposure device 12 is used to form an image.

The system controller 11 executes a control program stored in a memory and gives an operation control instruction to the exposure device 12, the photoconductor unit 13, the developing device 14, the transfer device 15, the sheet transport devices 16*a*, 16*b*, and 16*c*, the fixing device 17, the image reading device 18, and the like included in the image forming unit 10.

In addition, the system controller 11 gives an operation control instruction to the power controller 101 included in the image forming unit 10. That is, the system controller 11 determines whether or not the power controller 101 supplies power to the image forming unit 10 and the sheet feeding device 20, and gives the determination result as an instruction to the power controller 101.

Furthermore, the system controller 11 recognizes a processing request input by the operation information unit 40 included in the image forming unit 10 or a processing request input by a host computer 82 connected to the image forming unit 10 via a communication line 81, and accepts such a processing request.

The image processing unit 50 performs various processing processes on input image data and sends the resulting image data to the image forming unit 10. Specifically, data expressed in a page description language (PDL) is transmitted from the host computer 82 via the communication line 81, and a PDL interpretation section 51 performs command interpretation on the transmitted data. A color conversion section 53 converts color signals (RGB) specified in the PDL into color signals (YMCK) for the image forming unit 10.

Furthermore, a screen controller 54 serving as an exemplary image correction unit performs a screen process (binary conversion processing) on color signals (YMCK) on which gamma adjustment has been performed by a visualization section 52 and the resulting data is halftone image data.

Note that screen processes include a dot screen process and a line screen process. The dot screen process is a process in which dots are arranged with a certain gap therebetween and gradation is expressed by changing the size of each dot. The line screen process is a process in which lines are arranged with a certain gap therebetween and gradation is expressed by changing the thickness of each line. In the following description, image data on which either of the screen processes has been performed is called halftone image data.

The image forming unit 10 performs pulse-width modulation on halftone image data, which has resulted from a screen process performed by the screen controller 54, and outputs the resulting image data to the exposure device 12.

Thereafter, as described above, the image forming unit 10 forms a toner image on a sheet by using the resulting image data. The toner image is fixed by the fixing device 17 and the sheet is guided to the sheet ejecting unit 30. If needed, the amount of toner per unit area on the intermediate transfer belt 151 is measured and image forming conditions are changed, or the colors of a fixed image are measured and image forming conditions are changed via the operation information unit 40. As a result, image quality adjustment is performed.

(2) Image Quality Adjustment Operation of Image Forming Apparatus and its Effects In the following, image adjustment operation performed in the image forming apparatus 1 according to the first exemplary embodiment will be described with reference to the drawings.

Figure 3:
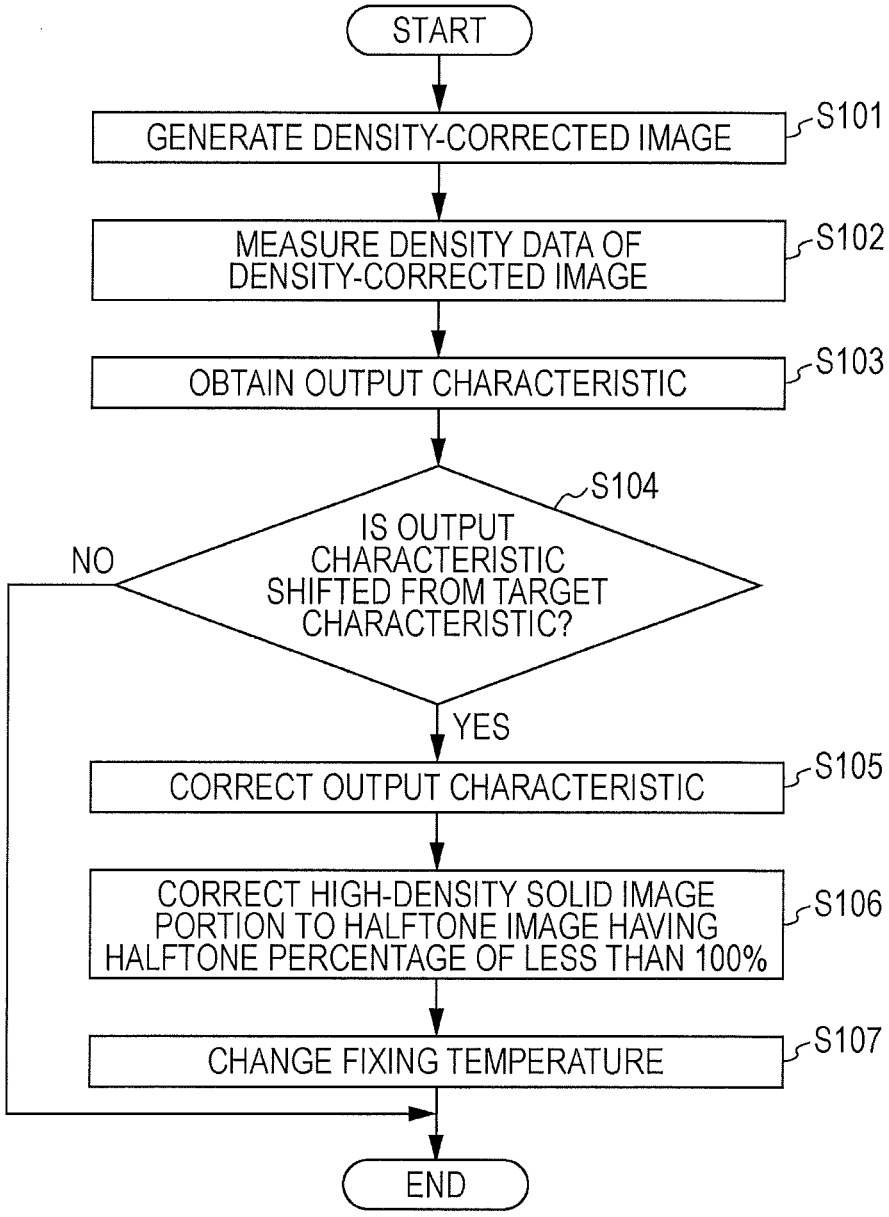
FIG. 3 is a flowchart illustrating the flow of processing in image quality adjustment operation performed in the image forming apparatus.
Figure 4A:
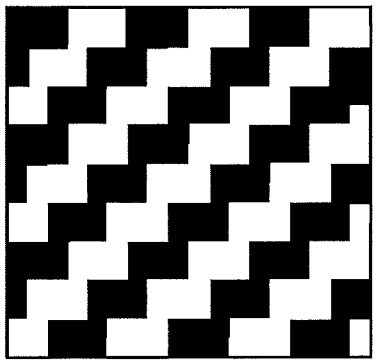
FIG. 4A is a diagram illustrating an example of a density corrected image.
Figure 4B:
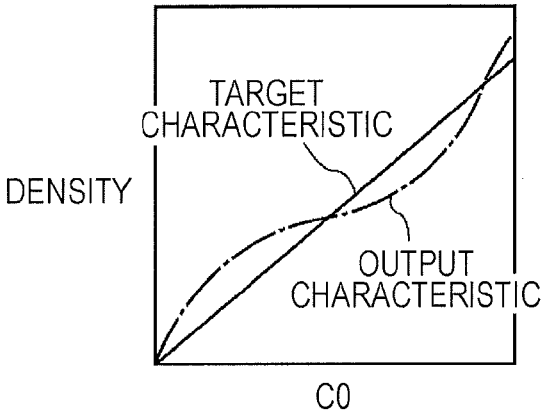
FIGS. 4B and 4C are diagrams illustrating relationships between an output characteristic and a correction characteristic.
Figure 4C:
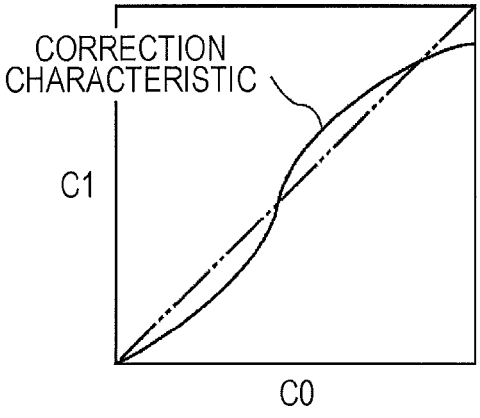
Figure 5:
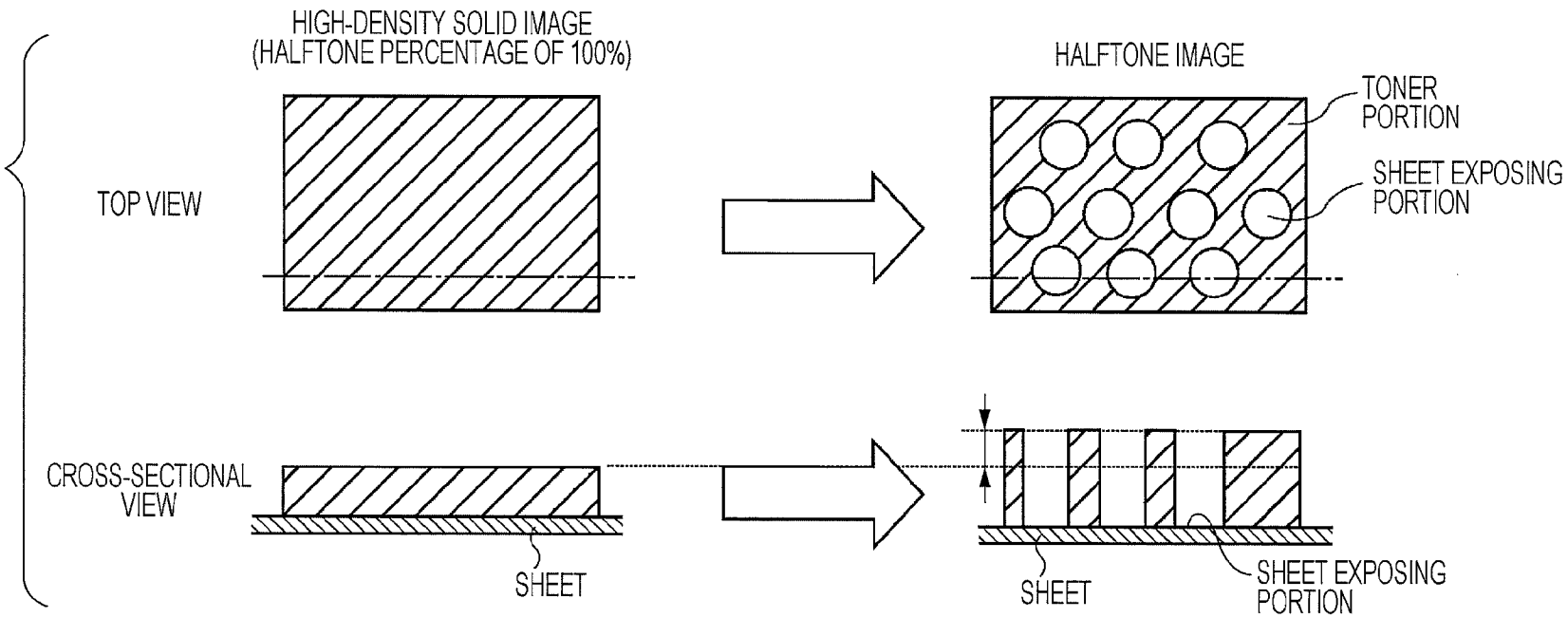
FIG. 5 is a schematic diagram illustrating the structure of a toner image formed on a sheet in the case where halftone processing is performed on a high-density solid image portion (a halftone percentage of 100%)

FIG. 3 is a flowchart illustrating the flow of processing in image quality adjustment operation performed in the image forming apparatus 1. FIG. 4A is a diagram illustrating an example of a density corrected image and FIGS. 4B and 4C are diagrams illustrating relationships between an output characteristic and a correction characteristic. FIG. 5 is a schematic diagram illustrating the structure of a toner image on a sheet in the case where halftone processing has been performed on a high-density solid image portion (a halftone percentage of 100%).

(2.1) Image Quality Adjustment Operation

In the image forming apparatus 1, it is necessary to adjust conditions set in an image forming process unit in order to form a high-quality image on various recording mediums. In particular, high productivity and faithful color reproduction of output images are needed in the field of printing.

In contrast, defects may occur in a formed image due to various factors such as use conditions (area coverage, color proportion, the number of sheets printed consecutively, and the like), changes in a use environment such as temperature or humidity, and the like. For example, when the charge amount of toner used in image forming reduces, the amount of toner per unit area of an image developed on a photoconductor drum 131 increases and an image density serving as an output characteristic increases. As a result, the resulting image density may be higher than an image density serving as a target characteristic.

In order to prevent such a defect from occurring, the image forming apparatus 1 performs correction processing on image data. As exemplary correction processing, for example, a density-corrected image is generated that is a dedicated image for performing image density detection on the intermediate transfer belt 151, the formed density-corrected image is read by a density sensor or the like that serves as an exemplary measurement unit, and image forming conditions are changed. Alternatively, the density-corrected image on a sheet is read by the image reading device 18 serving as another exemplary measurement unit and image forming conditions are changed. In addition, a user measures the colors of a fixed image and performs image quality adjustment setting by using the operation information unit 40, and the density of an image represented by image data is changed.

A concrete example of correction in which, when an image density increases, the image density is reduced to an image density serving as a target characteristic (hereinafter simply referred to as a target image density) will be described below. The screen controller 54 performs image quality adjustment in which halftone processing is performed on a high-density solid image portion (whose halftone percentage is 100%), as an example of a non-halftone image, such that the high-density solid image portion is changed to a halftone image whose halftone percentage is less than 100%. The density of the high-density solid image portion is made to match an image density obtained before the amount of toner per unit area has increased.

As a result, the density of the high-density solid image portion matches the target image density; however, the high-density solid image portion has a dotted structure and a range in which color reproduction is possible (hereinafter referred to as a color gamut) may be narrowed. The high-density solid image portion, that is, a non-halftone image, tends not to be affected by the type of base used (a sheet or the like). In contrast, the base may be seen in a halftone image. It is assumed that the color gamut of a halftone image becomes narrower than that of a non-halftone image because diffused reflection and irregular reflection increase.

In the case where the amount of toner per unit area has increased and the density of an output image has increased, the image forming apparatus 1 according to the first exemplary embodiment causes the screen controller 54 to perform halftone processing on a high-density solid image portion and makes the density of an output image match a target image density. Then, the fixing energy is increased by changing the fixing conditions of the fixing device 17, and consequently, the color gamut of the output image, on which halftone processing has been performed, is enlarged. The color gamut of the output image may be prevented from being narrowed while the density of the output image is matching a target image density.

In the following, the flow of processing performed in the entirety of the image forming apparatus 1 in the image quality adjustment operation will be described in detail with reference to the drawings.

Before a specified image forming process is started, the image forming apparatus 1, to which an instruction for the image quality adjustment operation has been input via the operation information unit 40, sends an image signal to the image forming unit 10 serving as a density-corrected image forming unit, the image signal being used for outputting a density-corrected image for gradation correction. As a result, the image forming unit 10 forms, on the intermediate transfer belt 151, a color chart P0 serving as a density-corrected image formed under the current conditions set in the image forming process unit (step S101).

Note that, a color chart P0 to be formed may be selected in accordance with characteristics of the image forming process unit. For example, such a color chart P0 is formed by a density corrected image formed on the basis of image data of an image that has colors and has, for each of the colors, an image percentage of 50% (see FIG. 4A).

Then, the density data of the density corrected image is measured by a density sensor or the like that serves as an exemplary measurement unit (step S102). A current output characteristic (gradation characteristic) of the image forming apparatus 1 is obtained by associating the obtained image density information and the image signal supplied to the image forming unit 10 with each other (step S103), the image signal being used to output a corresponding density-corrected image.

The obtained output characteristic is sent to the screen controller 54 serving as an exemplary image correction unit. It is checked whether or not image correction needs to be performed with respect to a target characteristic (step S104).

In the case where it is determined that the output characteristic is shifted from a certain target characteristic by a certain amount or more (Yes in step S104), when the output density is higher than the output density corresponding to the target characteristic, the value of an input image signal C0 is made smaller than its original value. When the output density is lower than the output density corresponding to the target characteristic, the value of the certain input image signal C0 is made greater than its original value (step S105).

Here, when it is determined that the output characteristic is not shifted from the target characteristic by a certain amount or more (No in step S104), image quality adjustment operation is finished.

As a result, the correction characteristic corresponding to the output characteristic and the target characteristic illustrated in FIG. 4B is determined to be a correction characteristic illustrated in FIG. 4C. C0 denotes an input image signal before correction (hereinafter referred to as a pre-correction input image signal) and C1 denotes an input image signal after correction (hereinafter referred to as a post-correction input image signal).

With reference to FIG. 4C, the value of a post-correction input image signal C1 is smaller than that of a pre-correction input image signal C0. Thus, the post-correction input image signal C1 is supplied to the image forming unit 10, and the screen controller 54 performs a screen process on a high-density solid image portion (whose halftone percentage is 100%) such that the high-density solid image portion is changed to a halftone image whose halftone percentage is less than 100%, and halftone image data is obtained (step S106).

In the case where a screen process has been performed, a high-density solid image portion (whose halftone percentage is 100%) is not output and a sheet exposing portion may appear on a sheet due to the screen process (see FIG. 5).

As a result, in the case where a screen process has been performed, the color gamut obtained at a certain brightness level becomes narrower than the color gamut obtained when the pre-correction input image signal C0 is output in the maximum density.

Furthermore, in the case where a screen process has been performed, the color gamut obtained at a certain color phase becomes also narrower than the color gamut obtained when the pre-correction input image signal C0 is output in the maximum density.

Thus, the image forming apparatus 1 changes the fixing temperature in the fixing device 17 in the case where a screen process (binary conversion processing) has been performed by the screen controller 54 and halftone image data is obtained (step S107).

Figure 6A:
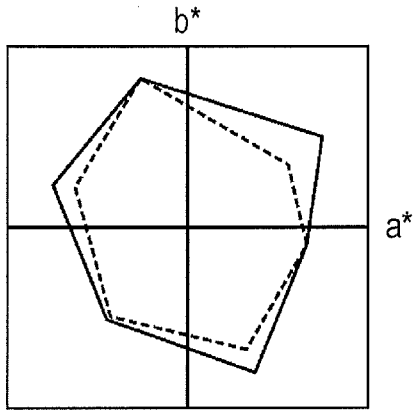
FIG. 6A is a diagram illustrating an example of a color gamut obtained at a certain brightness level.

FIG. 6A illustrates an example of a color gamut obtained at a certain brightness level. In FIG. 6A, a broken line represents a color gamut obtained in the case where a screen process has been performed and a solid line represents a color gamut obtained in the case where fixing conditions are changed when a screen process is performed. Specifically, a fixing temperature is set to a higher temperature and the fixing energy is increased.

As illustrated in FIG. 6A, it is understood that the color gamut represented by the solid line and obtained in the case where the fixing conditions have been changed is larger than the color gamut represented by the broken line and obtained in the case where the screen process has been performed.

Figure 6B:
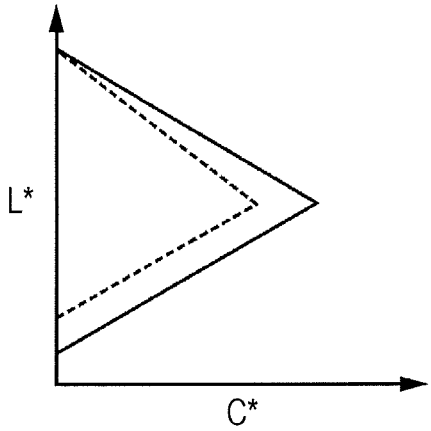
FIG. 6B is a diagram illustrating an example of a color gamut obtained at a certain color phase.

Furthermore, FIG. 6B illustrates an example of a color gamut obtained at a certain color phase. From FIG. 6B, too, it is understood that the color gamut represented by the solid line and obtained in the case where the fixing conditions have been changed is larger than the color gamut represented by the broken line and obtained in the case where a screen process has been performed.

As a change in the fixing conditions, the fixing temperature is set to a higher temperature. As a result, the melting rate of the toner on the sheet is increased and the toner particles of a toner layer formed on the sheet are spread evenly, or the gaps between adjacent toner particles are reduced.

As a result, it is harder to see the base and, simultaneously, unevenness of the surface of the toner layer is reduced and reduction in color forming due to diffused reflection or irregular reflection occurring inside the toner layer is reduced. As a result, it is assumed that the color gamut of an output image is enlarged even when the amount of toner is reduced by halftone processing.

Note that the case where the fixing temperature is increased and the fixing energy is increased in the fixing device 17 has been described. However, for example, the fixing energy may be increased by changing a fixing time period or by changing the nip width of a fixing nip, the fixing time period being changed by changing the image forming speed, the nip width of the fixing nip being changed by increasing the pressure applied by the compression roller 172. Furthermore, soaking of toner into a sheet may be suppressed by reducing the fixing pressure while the melting rate of the toner is increased by setting the fixing temperature to a higher temperature.

Second Exemplary Embodiment

In the case where the amount of toner per unit area has increased and the density of an output image has increased, similarly to the image forming apparatus 1 according to the first exemplary embodiment, an image forming apparatus 1A according to a second exemplary embodiment causes the screen controller 54 to perform halftone processing on a high-density solid image portion such that the high-density solid image portion is changed to a halftone image whose halftone percentage is less than 100%, and makes the density of an output image match a target image density.

By referring to information about color-gamut enlarging effects obtained by changing the fixing temperature in response to the degree to which the color gamut is narrowed by performing halftone processing, the fixing conditions of the fixing device 17 are changed such that the degree to which the color gamut is narrowed by performing halftone processing is reduced, the information having been stored in advance.

Thus, in the following description, components the same as those in the image forming apparatus 1 according to the first exemplary embodiment are denoted by the same reference numerals and the description thereof will be omitted.

The color gamut may be enlarged by performing halftone processing on a high-density solid image portion and by increasing the fixing temperature. However, when the fixing temperature is increased more than necessary, inconsistencies in gloss, in soaking of toner, in melting of toner, and the like may appear on a fixed image.

Figure 7A:
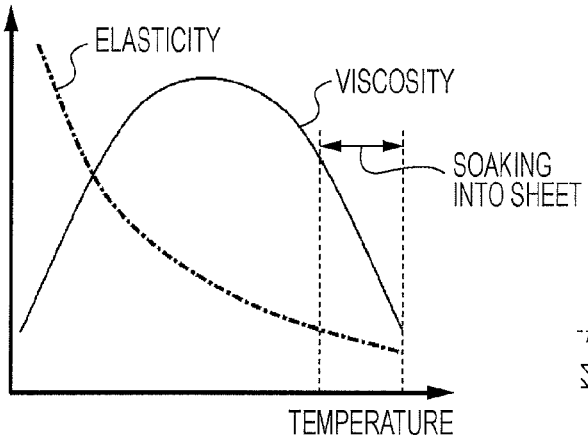
FIGS. 7A and 7B are schematic diagrams illustrating a state in which fixing energy is added to a toner image on which halftone processing has been performed and that is formed on a sheet and the toner melts.
Figure 7B:
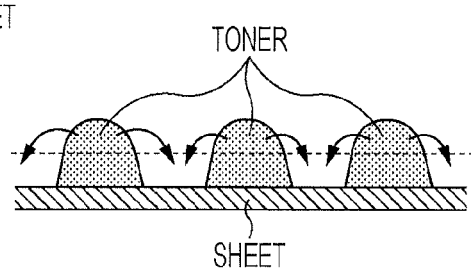

For example, the fixing conditions are changed depending on the characteristics of sheets to be used; however, the fixing temperature, which is changed in accordance with the thickness of a sheet, has an acceptable upper limit. FIGS. 7A and 7B schematically illustrate a state in which fixing energy is applied to a toner image formed on a sheet and the toner is melting, halftone processing having been performed on the toner image.

The viscosity of toner approaches a peak value as the fixing temperature increases, and reaches the peak value. When the fixing temperature is increased more than necessary, the viscosity of toner decreases and the toner tends to flow and soaks into a sheet. On the other hand, for example, in a partial area in which the thickness of the sheet is larger than the surrounding area, heat is absorbed by the sheet and melting is suppressed in contrast to the surrounding area due to the unevenness of a sheet surface. The toner tends to flow into a partial area in which the thickness of the sheet is smaller than the surrounding area.

It is assumed that, as a result, tiny bumps and dips are generated on the surface of the toner image and inconsistencies in gloss, in soaking of toner, in melting of toner, and the like may appear on the fixed image.

Figure 8:
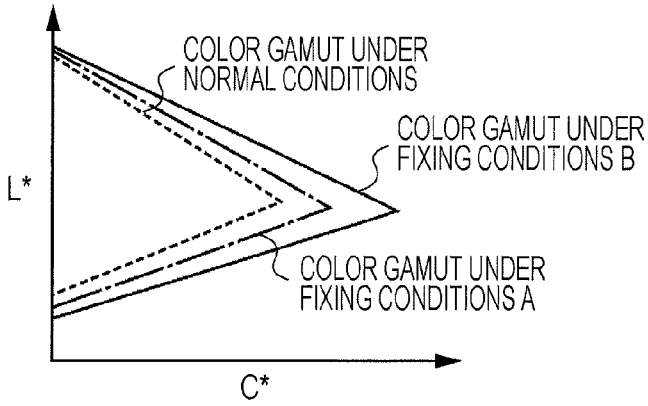
FIG. 8 is a diagram illustrating an example of the color gamut of an image on which halftone processing has been performed and that is output.

FIG. 8 is a diagram used to describe an example in which the color gamut of an image on which halftone processing has been performed and that is output from the image forming unit 10 is changed by changing the fixing conditions.

As illustrated in FIG. 8, the color gamut obtained at a certain color phase may be controlled to be larger by controlling the fixing conditions of the fixing device 17.

In the image forming apparatus 1A, as shown in the example illustrated in FIG. 8, a correspondence table has been stored in advance in the ROM of the system controller 11. In the correspondence table, for each halftone processing operation, for example, for each halftone percentage, color-gamut data and certain fixing conditions of the fixing device 17 are stored in association with the halftone percentage.

In the case where the amount of toner per unit area has increased and the density of an output image has increased, the image forming apparatus 1A causes the screen controller 54 to perform halftone processing on a high-density solid image portion such that the high-density solid image portion is changed to a halftone image whose halftone percentage is less than 100%. For each halftone processing operation, by referring to the correspondence table that is stored in the ROM of the system controller 11 and in which color-gamut data and certain fixing conditions are associated with each other, the fixing conditions of the fixing device 17 are changed such that the degree to which the color gamut is narrowed by performing halftone processing is reduced.

Third Exemplary Embodiment

In the case where the amount of toner per unit area has increased and the density of an output image has increased, an image forming apparatus 1B according to a third exemplary embodiment causes the screen controller 54 to perform halftone processing on a high-density solid image portion such that the high-density solid image portion is changed to a halftone image whose halftone percentage is less than 100%, and makes the density of an output image match a target image density.

Then, the image forming unit 10 outputs an image on which halftone processing has been performed under the current conditions set in the image forming process unit. The image information on the output image is detected. The difference between the color gamut of the output image and a predetermined color gamut is calculated. The fixing conditions of the fixing device 17 are changed such that the degree to which the color gamut of the output image is narrowed by performing halftone processing is reduced.

Thus, in the following description, components the same as those in the image forming apparatus 1 according to the first exemplary embodiment are denoted by the same reference numerals and the description thereof will be omitted.

The image forming apparatus 1B includes an image information detector in order to detect image information on an output image. Specifically, an example of the image information detector is a development density detection sensor. The toner density of a toner image transferred onto the intermediate transfer belt 151 is detected by a development density detection sensor. The detected toner density is transmitted to the system controller 11.

In the image forming apparatus 1B, a correspondence table and a reference value of a color-gamut range desired to be achieved in the image forming apparatus 1B have been stored in the ROM of the system controller 11 in advance. In the correspondence table, for each toner density, color-gamut data and certain fixing conditions of the fixing device 17 are stored in association with the toner density. In accordance with the detected amount of toner, the difference between an estimated current color gamut and the reference value of the color-gamut range is calculated by referring to the correspondence table, which is stored and in which, for each toner density, color-gamut data and certain fixing conditions of the fixing device 17 are stored in association with the toner density. In the case where the difference exceeds a predetermined threshold, the fixing conditions of the fixing device 17 are changed.

Moreover, the image reading device 18, which is provided downstream of the fixing device 17, may also be used as the imager information detector. The image forming unit 10 outputs an image on which halftone processing has been performed under the current conditions set in the image forming process unit. The image reading device 18 reads the output image. The color conversion section 53 performs color space conversion.

The difference between an estimated current color gamut and the reference value of the color gamut range is calculated by referring to a correspondence table, in which color-gamut data and certain fixing conditions of the fixing device 17 are associated with each other and which has been stored in the ROM of the system controller 11 in advance. In the case where the difference exceeds a predetermined threshold, the fixing conditions of the fixing device 17 are changed.

Fourth Exemplary Embodiment

In the case where the amount of toner per unit area has increased and the density of an output image has increased, an image forming apparatus 1C according to a fourth exemplary embodiment causes the screen controller 54 to perform halftone processing on a high-density solid image portion such that the high-density solid image portion is changed to a halftone image whose halftone percentage is less than 100%, and makes the density of an output image match a target image density.

Then, the degree to which the color gamut of the output image is narrowed by performing halftone processing is reduced by changing the fixing conditions of the fixing device 17.

In contrast, in the case where, as a result of changing the fixing conditions, the color gamut that has been narrowed is enlarged to the maximum color gamut that may be realized using toner, the color phase of an intermediate-tone region may be shifted from the color phase originally planned to be achieved. In particular, the color phase of a multicolor intermediate-tone region is shifted from the color phase originally planned to be achieved, even when dots of input image signals obtained when the fixing conditions are not changed are overlapped each other, each of the input image signals being a corresponding one of color signals.

In the case where halftone processing has been performed on a high-density solid image portion, the image forming apparatus 1C measures, again, the colors of an image whose color gamut has been enlarged by changing the fixing conditions. Halftone processing is performed again such that the color reproduction of all input image signals obtained after halftone processing becomes almost the same as the color reproduction obtained in the case where halftone processing is not performed.

Thus, in the following description, components the same as those in the image forming apparatus 1 according to the first exemplary embodiment are denoted by the same reference numerals and the description thereof will be omitted.

Figure 9:
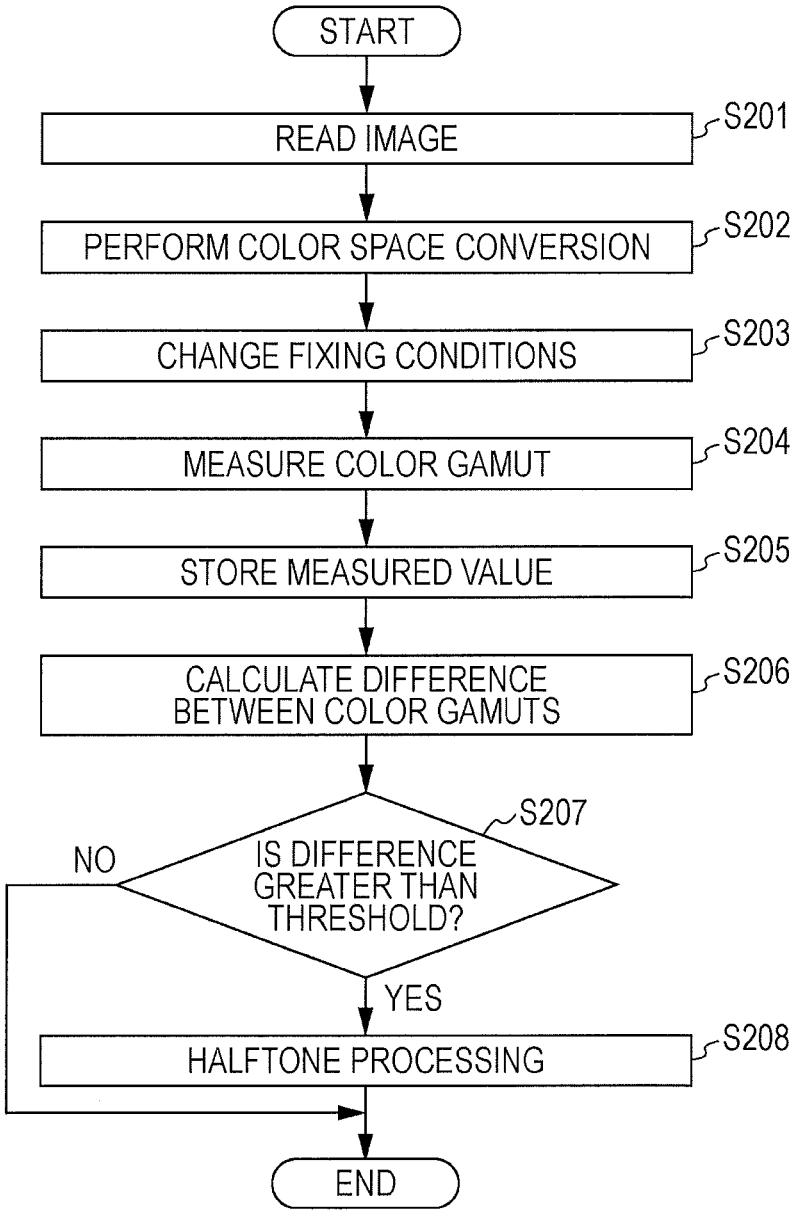
FIG. 9 is a flowchart used to describe an example of image quality adjustment operation performed by an image forming apparatus.

FIG. 9 is a flowchart used to describe the flow of processing in image quality adjustment operation performed by the image forming apparatus 1C.

The image forming unit 10 outputs an image on which halftone processing has been performed, under the current conditions set in the image forming process unit and the output image is read by the image reading device 18 (step S201). Color space conversion is performed by the color conversion section 53 (step S202).

For each halftone processing operation, by referring to a correspondence table in which color-gamut data and certain fixing conditions are associated with each other and that is stored in the ROM of the system controller 11, the fixing conditions of the fixing device 17 are changed such that the degree to which the color gamut is narrowed by performing halftone processing is reduced (step S203).

Next, the image on which halftone processing has been performed is output under the fixing conditions changed in step S203. The output image is measured by, for example, a color-gamut sensor (SpectroEye from X-Rite) (step S204). The color-gamut data measured by the color-gamut sensor is stored in an external server connected to the image forming apparatus 1 via a communication line (step S205). The color conversion section 53 reads the color-gamut data from the external server, calculates the difference between the read color gamut and the color gamut obtained in the case where halftone processing has not been performed in a full-tone region (step S206). It is determined whether or not halftone processing needs to be changed (step S207).

When the difference calculated in step S206 is larger than a predetermined threshold (YES in step S207), the image forming apparatus 10 performs halftone processing again such that color reproduction becomes almost the same as the color reproduction obtained in the case where halftone processing is not performed in a full-tone region (step S208).

Thereafter, image forming is performed under the fixing conditions changed (or set) in step S203.

The exemplary embodiments according to the invention have been described in the above; however, the invention is not limited to the above-described exemplary embodiments. Various changes may be performed within the gist of the present invention described in the claims.

For example, the image forming apparatuses 1, 1A, 1B, and 1C are described as printers; however, the image forming apparatuses 1, 1A, 1B, and 1C may also be copying machines with a function of reading documents.

Note that, in the specification of the present application, an exemplary embodiment has been described in which a program has been installed in advance. However, it is also possible to provide the program by storing the program in a recording medium such as a compact disc-read-only memory (CD-ROM) or by downloading the program in a memory provided in an image forming apparatus from a server apparatus or the like connected to a network such as the Internet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image represented by image data as a toner image;

a density-corrected image forming unit that forms a density corrected image;

a measurement unit that measures the density of the density corrected image formed by the density-corrected image forming unit;

an image correction unit that performs image correction on the basis of the density corrected image such that a non-halftone image represented by data included in image data is formed as a halftone image whose halftone percentage is less than 100%, the density of the density corrected image having been measured by the measurement unit; and a fixing unit that, in a case where image correction is performed for image data by the image correction unit, fixes a toner image on a recording medium with at least one of an increased fixing temperature, an increased fixing time period, and an increased fixing pressure, the toner image being based on the image data for which image correction has been performed.

2. The image forming apparatus according to claim 1, wherein at least one of the fixing temperature, the fixing time period, and the fixing pressure in the fixing unit is increased on the basis of the halftone percentage, less than 100%, of a halftone image resulting from image correction performed by the image correction unit.

3. The image forming apparatus according to claim 2, further comprising a color-gamut enlargement information memory that stores color-gamut enlargement information on a toner image that is to be fixed on a recording medium by increasing at least one of the fixing temperature, the fixing time period, and the fixing pressure, wherein at least one of the fixing temperature, the fixing time period, and the fixing pressure in the fixing unit is increased on the basis of color-gamut enlargement information stored in the color-gamut enlargement information memory such that the color gamut of the toner image based on the image data for which image correction has been performed matches the color gamut of the toner image obtained before the image correction.

4. The image forming apparatus according to claim 1, further comprising an image-information sensor that senses image information on an image formed as a toner image by the image forming unit, wherein at least one of the fixing temperature, the fixing time period, and the fixing pressure in the fixing unit is increased on the basis of the difference between a color gamut calculated on the basis of the sensed image information and a color-gamut reference value in a predetermined color-gamut range.

5. The image forming apparatus according to claim 4, wherein the image information is information on the density of the density corrected image measured by the measurement unit or information on the color gamut of the toner image fixed on the recording medium by the fixing unit.

6. The image forming apparatus according to claim 1, wherein the image correction unit newly performs image correction such that a halftone image whose halftone percentage is less than 100% is formed from the image data, on the basis of the difference between the color gamut of a toner image formed by increasing at least one of the fixing temperature, the fixing time period, and the fixing pressure in the fixing unit and the color gamut obtained when the image correction unit does not perform image correction for the image data.

7. The image forming apparatus according to claim 2, wherein the image correction unit newly performs image correction such that a halftone image whose halftone percentage is less than 100% is formed from the image data, on the basis of the difference between the color gamut of a toner image formed by increasing at least one of the fixing temperature, the fixing time period, and the fixing pressure in the fixing unit and the color gamut obtained when the image correction unit does not perform image correction for the image data.

8. The image forming apparatus according to claim 3, wherein the image correction unit newly performs image correction such that a halftone image whose halftone percentage is less than 100% is formed from the image data, on the basis of the difference between the color gamut of a toner image formed by increasing at least one of the fixing temperature, the fixing time period, and the fixing pressure in the fixing unit and the color gamut obtained when the image correction unit does not perform image correction for the image data.

9. The image forming apparatus according to claim 4, wherein the image correction unit newly performs image correction such that a halftone image whose halftone percentage is less than 100% is formed from the image data, on the basis of the difference between the color gamut of a toner image formed by increasing at least one of the fixing temperature, the fixing time period, and the fixing pressure in the fixing unit and the color gamut obtained when the image correction unit does not perform image correction for the image data.

10. The image forming apparatus according to claim 5, wherein the image correction unit newly performs image correction such that a halftone image whose halftone percentage is less than 100% is formed from the image data, on the basis of the difference between the color gamut of a toner image formed by increasing at least one of the fixing temperature, the fixing time period, and the fixing pressure in the fixing unit and the color gamut obtained when the image correction unit does not perform image correction for the image data.

11. A non-transitory computer readable medium storing a program causing a computer to execute a process, the process comprising:

forming an image represented by image data as a toner image;

forming a density corrected image;

measuring the density of the formed density corrected image;

performing image correction on the basis of the density corrected image such that a non-halftone image represented by data included in image data is formed as a halftone image whose halftone percentage is less than 100%, the density of the density corrected image having been measured; and in a case where image correction is performed for image data, fixing a toner image on a recording medium with at least one of an increased fixing temperature, an increased fixing time period, and an increased fixing pressure, the toner image being based on the image data for which image correction has been performed.

12. An image forming method comprising:

forming an image represented by image data as a toner image;

forming a density corrected image;

measuring the density of the formed density corrected image;

performing image correction on the basis of the density corrected image such that a non-halftone image represented by data included in image data is formed as a halftone image whose halftone percentage is less than 100%, the density of the density corrected image having been measured; and in a case where image correction is performed for image data, fixing a toner image on a recording medium with at least one of an increased fixing temperature, an increased fixing time period, and an increased fixing pressure, the toner image being based on the image data for which image correction has been performed.

* * * * *